US006230966B1

(12) United States Patent
Beales et al.

(10) Patent No.: US 6,230,966 B1
(45) **Date of Patent: *May 15, 2001**

(54) MULTI-PACK HINGED LID CIGARETTE CARTON WITH OPEN BOTTOM

(75) Inventors: Jonathan T. Beales, Hayes, VA (US); Genine Regante, Tinton Falls, NJ (US)

(73) Assignee: Philip Morris Incorporated, New York, NY (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/004,884

(22) Filed: Jan. 9, 1998

(51) Int. Cl.[7] ..... B65D 43/16

(52) U.S. Cl. ..... 229/160.1; 229/103.2; 229/103.3; 229/184; 206/434; 206/920

(58) Field of Search ..... 206/68, 434, 418, 206/421; 229/920, 103.2, 103.3, 160.1, 128, 137, 184

(56) References Cited

U.S. PATENT DOCUMENTS

| | | | | |
|---|---|---|---|---|
| 1,301,161 | * | 4/1919 | Ohara | 206/418 X |
| 1,587,038 | * | 6/1926 | Sandor | 206/418 |
| 2,605,897 | | 8/1952 | Rundle . | |
| 3,337,033 | * | 8/1967 | Cote | 206/418 X |
| 3,705,681 | * | 12/1972 | Rossi et al. | 229/103.2 X |
| 3,752,308 | | 8/1973 | Begemann . | |
| 4,441,650 | * | 4/1984 | Caldwell et al. | 206/434 X |
| 4,445,613 | * | 5/1984 | Cassidy | 206/418 |
| 4,556,593 | * | 12/1985 | Muller | 206/434 X |
| 4,738,359 | | 4/1988 | Phillips, Jr. . | |
| 4,895,296 | * | 1/1990 | Trauschke | 206/420 X |
| 5,074,412 | * | 12/1991 | White | 229/160.1 X |
| 5,092,467 | * | 3/1992 | Elward | 229/103.2 X |
| 5,143,213 | | 9/1992 | Moore et al. . | |
| 5,147,037 | | 9/1992 | Evers et al. . | |
| 5,161,733 | | 11/1992 | Latif . | |
| 5,197,657 | * | 3/1993 | Cassidy et al. | 229/103.2 X |
| 5,277,304 | | 1/1994 | Brizzi et al. . | |
| 5,351,820 | | 10/1994 | Focke et al. . | |

FOREIGN PATENT DOCUMENTS

| | | |
|---|---|---|
| 295 16 763 U 1 | 3/1996 | (DE) . |
| 1 049 504 | 12/1953 | (FR) . |
| 2 662 664 | 12/1991 | (FR) . |
| 706393 | 3/1954 | (GB) . |

* cited by examiner

*Primary Examiner*—Allan N. Shoap
*Assistant Examiner*—Tri M. Mai
(74) *Attorney, Agent, or Firm*—Connolly Bove Lodge & Hutz LLP

(57) ABSTRACT

A cigarette carton comprises opposite front and rear walls, opposing side walls, a top portion and a generally open bottom portion. The bottom portion comprises a plurality of closure flaps connected to at least several of the front, rear and side walls, and a horizontal hinge line connects each closure flap to its respective carton wall. Each closure flap has a fully open position where the flaps are inside the carton and rest on the carton walls to which they are connected to thereby enable cigarette packs to be placed in and removed from the carton. The closure flaps have a closed position where the flaps are positioned at an angle slightly inside the carton to retain the contents of the carton.

2 Claims, 3 Drawing Sheets

MULTI-PACK HINGED LID CIGARETTE CARTON WITH OPEN BOTTOM

BACKGROUND OF THE INVENTION

The present invention generally relates to cigarette cartons, and more particularly to a multi-pack hinged lid cigarette carton with an open bottom for ease in removing and repackaging the cigarette packs in the carton.

In the past, cigarettes have been sold in packs containing 20 cigarettes. These 20-cigarette packs have been packaged in cartons containing ten-packs, and more recently in five-packs holding five packs stacked in a lateral configuration, such as shown in U.S. Pat. No. 5,143,213, granted Sep. 1, 1992.

Revenue and tariff regulations require the application of revenue stamps on each individual cigarette pack, particularly shortly before the pack is sold to the ultimate consumer. As a consequence of this procedure, the revenue stamps cannot be applied during the initial packaging operation. Instead the retailer must open the carton, affix the revenue stamps to the individual cigarette packs and subsequently reclose the carton.

In other instances, the cigarette carton may include access openings therein adjacent each of the individual cigarette packs, and the revenue stamps are applied to the packs through these access openings. U.S. Pat. Nos. 5,147,037 and 5,351,820, granted Sep. 15, 1992, and Oct. 4, 1994, respectively, describe such access openings for the application of revenue stamps without removing the cigarette packs from the carton.

Revenue stamps are generally applied to individual cigarette packs after the initial packaging thereof in five- or ten-pack cartons. These stamps cannot be applied beforehand because the applicable revenue depends on the location of final sale. Hence, it becomes necessary to remove the cigarette packs from the carton in order to apply the revenue stamp. Alternatively, the cigarette carton may include features which enable revenue stamps to be applied to the individual packs without removal thereof from the carton such as access openings in the carton and similar features.

SUMMARY OF THE INVENTION

Accordingly, it is an object of the present invention to provide a cigarette carton with a generally open bottom wall which retains the individual cigarette packs in the carton but which enables easy removal of the cigarette packs as well as reassembly of the packs in the carton through the bottom wall.

In accordance with the present invention, a cigarette carton comprises opposite front and rear walls, opposing side walls, a top portion and a bottom portion. The bottom portion comprises a plurality of closure flaps connected to at least several of the front, rear and side walls. A horizontal hinge line is positioned between each flap and the carton wall to which it is connected. Each flap has a fully open position where it is located inside the carton directly against the carton wall to which it is connected. This position enables insertion and removal of the cigarette packs from the carton. Additionally, each flap has a closed position where it is positioned at an angle slightly inside the carton to thereby retain the carton contents.

Preferably the carton has four corners. At least some of the adjacent closure flaps of the bottom portion of the container are connected together by extended integral hinge lines for movement of the flaps between their fully open position and their closed position. The bottom portion also includes an anchor flap positioned within the carton directly against one of the carbon walls and connected to one of the closure flaps.

Preferably the closure flaps are connected to the front, rear and one of the side walls. Moreover, the flaps of the front and rear walls preferably are connected to the flaps of one of the side walls via the extended integral hinge lines.

The bottom portion of the carton has a central opening therein when the closure flaps are in their closed position. Also, the top portion of the carton may comprise a hinged lid cover integrally hinged to the rear wall of the carton along a generally horizontal axis for movement between open and closed positions.

BRIEF DESCRIPTION OF THE DRAWINGS

Novel features and advantages of the present invention in addition to those mentioned above will become apparent to persons of ordinary skill in the art from a reading of the following detailed description in conjunction with the accompanying drawing wherein.

DETAILED DESCRIPTION OF THE INVENTION

Figure 2:
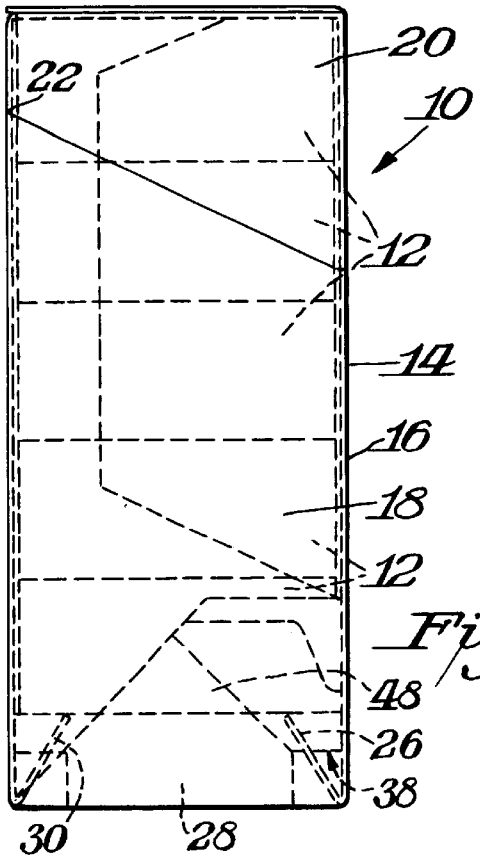
FIG. 2 is a left side elevational view of the cigarette carton shown in FIG. 1, according to the present invention.
Figure 1:
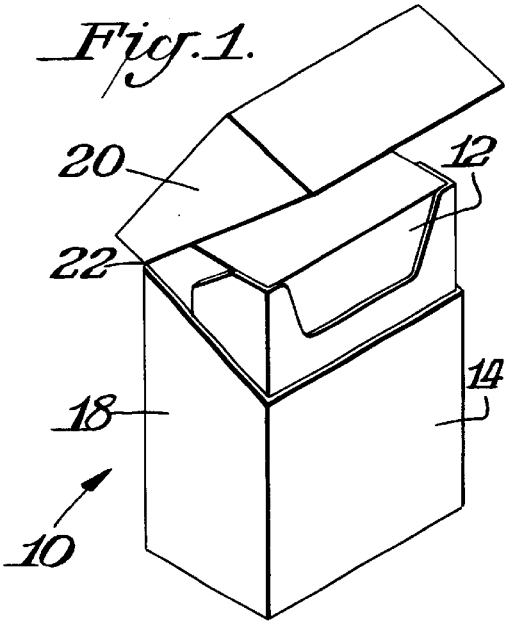
FIG. 1 is a perspective view of a multi-pack hinged lid cigarette carton with an open bottom, according to the present invention.

Referring more particularly to the drawings, FIG. 1 shows a multi-pack hinged lid cigarette carton 10, according to the present invention. The carton is used to package five packs of cigarettes 12 in a stack of five in side-to-side relationship. Fundamentally, the carton 10 has front and rear walls 14, 16, respectively, and opposing side walls 18. Carton 12 also has a top portion in the form of a flip-top cover 20 hinged to the rear wall 16 along a generally horizontal line 22 for movement between open and closed positions.

Figure 3:
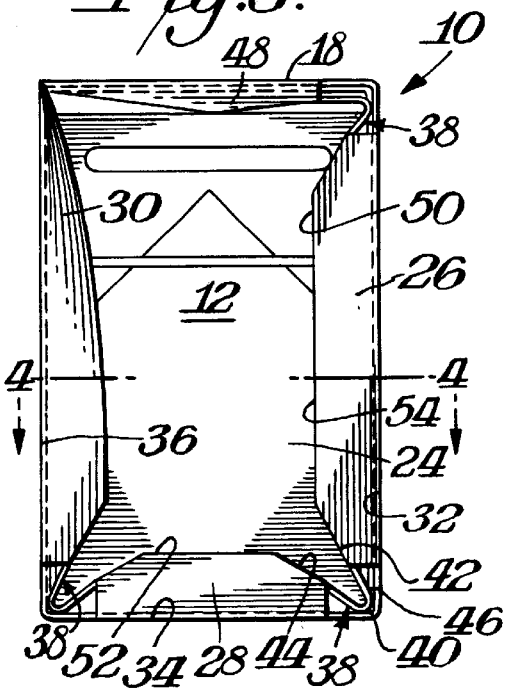
FIG. 3 is a bottom plan view of the cigarette carton shown in FIGS. 1 and 2, with the closure flaps positioned to retain the contents of the carton, according to the present invention.
Figure 4:
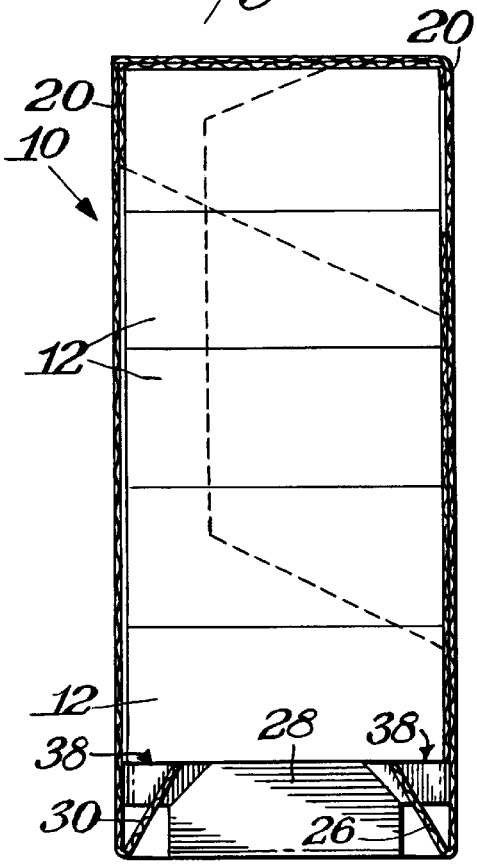
FIG. 4 is a sectional view taken along line 4—4 of FIG. 3.
Figure 5:
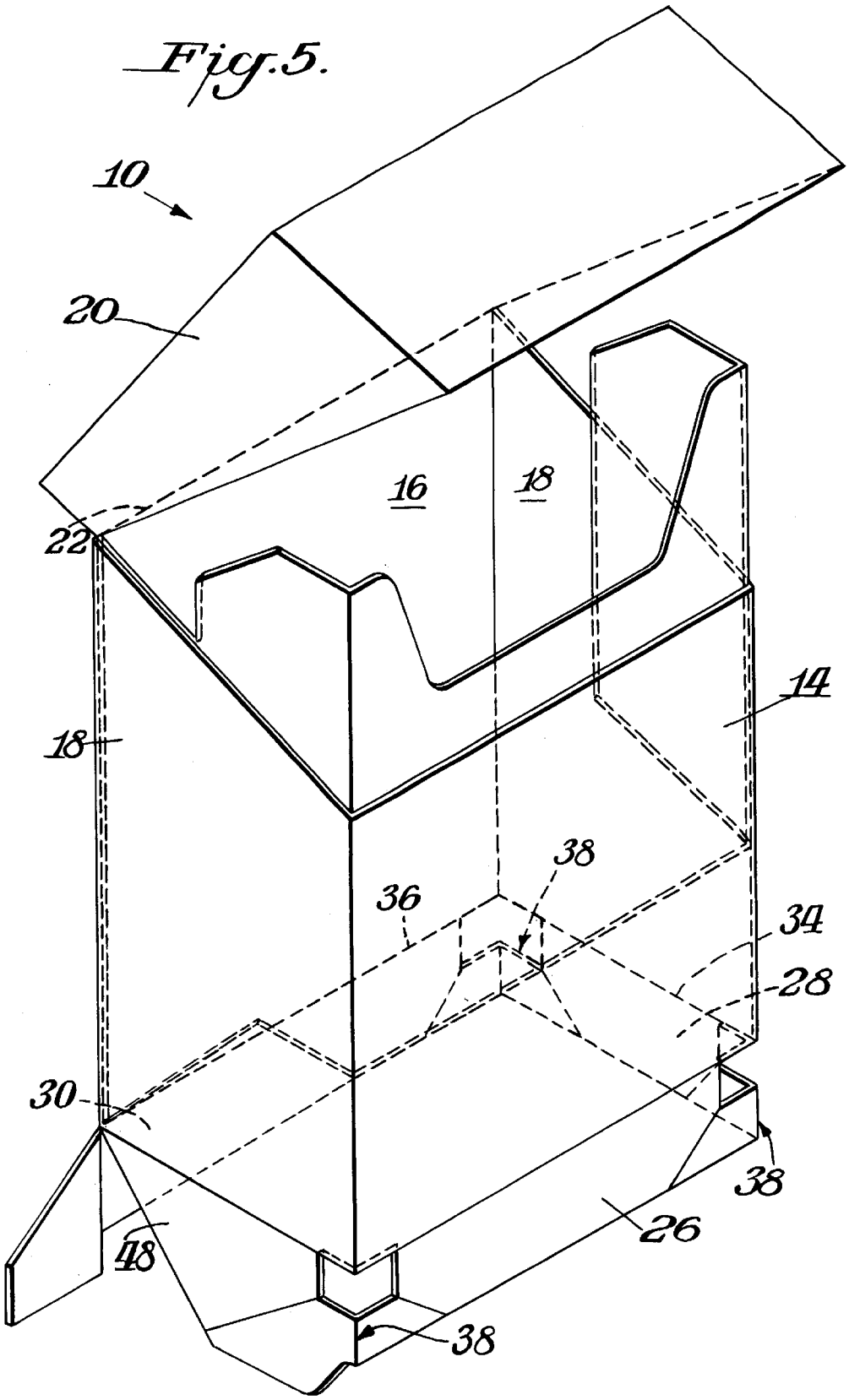
FIG. 5 is an enlarged perspective view similar to FIG. 1 but showing the carton in one of its assembly positions.
Figure 7:
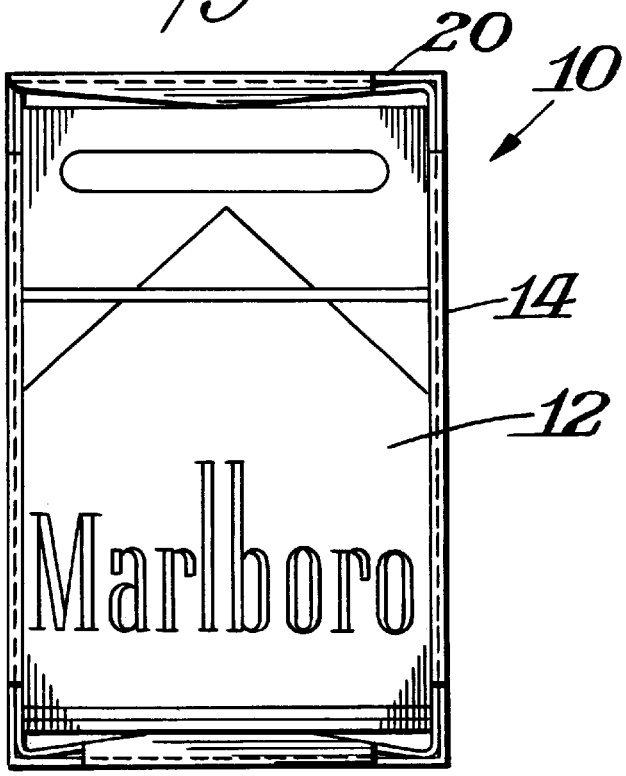
FIG. 7 is a bottom plan view of the carton of the present invention showing the open position of the closure flaps for packaging cigarette packs in the carton or removing packs therefrom.

Carton 10 also includes an open bottom 24, as shown best in FIGS. 3, 4 and 7. Basically, the open bottom comprises a plurality of interconnected closure flaps 26, 28 and 30. The interconnected flaps are connected to the front, rear and one of the side walls along horizontal hinge lines 32, 34, and 36. Closure flap 26 is connected to front wall 14 along horizontal hinge line 32 while closure flap 28 is connected to side wall 18 along hinge line 34. Similarly, closure flap 30 is connected to rear wall 16 along hinge line 36.

Figure 6:
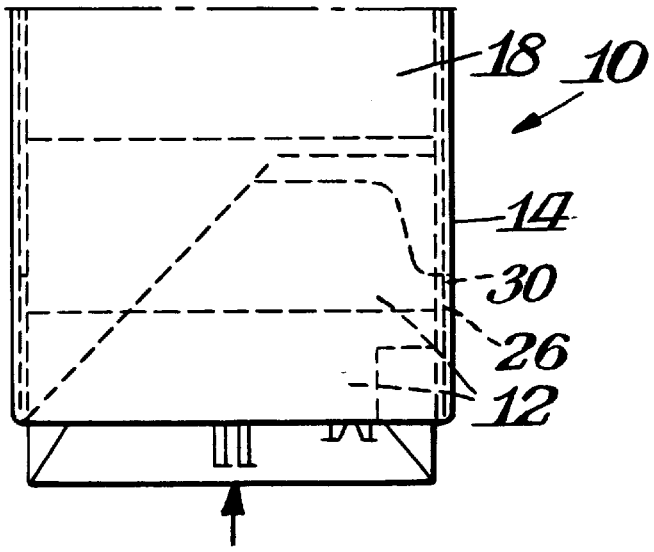
FIG. 6 is a fragmental left side elevational view of the lower portion of the carton with packs of cigarettes being packaged in the carton.

Each closure flap has a fully open position where the flaps are located inside the carton directly against the carton walls to which they are connected. This open position of the closure flaps as shown in FIGS. 6 and 7 enables the cigarette packs 12 to be placed within the carton 10 and also permits removal of the cigarette packs 12 from the carton, as explained more fully below. The closure flaps also have a closed position as shown in FIG. 3 where they are positioned slightly inside the carton to retain the contents of the carton.

The closure flaps are interconnected to each other at the corners of the carton 10. Hinge structure 38 between the closure flaps at the corners of carton functions to maintain the closure flaps at their closed positions slightly inside the carton. This closed position of the flaps functions to retain the cigarette packs contained within the carton. Each hinge structure 38 includes a first hinge line 40 and second hinge lines 42, 44 connected to the first hinge line by extended tabs 46 on opposite sides of the first hinge line 40.

When the closure flaps are in their open position the extended tabs 46 rest against the inside surface of the carton walls, and the first hinge line 40 is located at one of the corners of the carton. However, when the closure flaps are moved to their closed position, the first hinge line 40 is still close to one of the corners of the carton. The second hinge line 42, 44 are then slightly angled inside the carton to thereby position the closure flaps in their closed position blocking removal of the packs of cigarettes.

An anchor flap 48 is connected to one of the side walls 18 of the carton 10 opposite the side closure flap 28. The anchor flap remains within the interior of the carton generally against the carton side wall 18 to which it is connected. The anchor flap 48 is connected to the front closure flap 26 by the hinge structure 38 to thereby maintain the front closure flap and the side closure flap 28 inside the carton. Also, the end of the rear closure flap 30 adjacent the anchor flap 48 is connected to the inside wall structure of the carton to thereby maintain the rear closure flap 30 and the side closure flap 28 inside the carton As best shown in FIGS. 3 and 4, the bottom portion 24 of carton 10 has an opening defined by the inner edges of the closure flaps 26, 28 and 30. Overall, carton 10 enables the cigarette packs 12 to be packaged into the carton when the closure flaps are in their open position. The open position also enables removal of the cigarette packs 12 from the carton for the purpose of applying revenue stamps to the individual cigarette packs. After repackaging the cigarette packs with the appropriate revenue stamps applied thereto, the closure flaps are simply moved to their closed position described above. This position functions to retain the cigarette packs with in the carton.

Assuming carton 10 is empty, cigarette packs 12 may be loaded into the carton through the open bottom 24. Urging the cigarette packs 12 into the carton as shown in FIGS. 6 and 7 positions the closure flaps 26, 28 and 30 against the carton walls to which they are connected. When the last of the cigarette packs is inserted into the open bottom 24, the closure flaps 26, 28 and 30 snap to their closed positions once the last cigarette pack clears the closure flaps. The last cigarette pack holds the anchor flap 48 against its respective side wall 18. With the front closure flap 26 connected to anchor flap 48 and the rear closure flap connected to the inside of the carton, the closure flaps are maintained in their angled closed positions within the carton. The inside edges 50, 52 and 54 of the closure flaps engage the last cigarette pack to retain all of the cigarette packs within the carton.

When removal of the cigarette packs 12 is desired, the closure flaps are simply moved to their open positions against the inside carton walls to which they are connected, as best shown in FIGS. 6 and 7. The cigarette packs 12 may then be emptied through the open bottom 24.

What is claimed is:

1. A cigarette carton for cigarette packs comprising a hinged lid, opposite front and rear walls, opposing side walls, a top portion and a bottom portion, the bottom portion comprising first, second, third and fourth interconnected closure flaps connected to the front, rear and side walls, a horizontal hinge line between each flap and the carton wall to which it is connected, each closure flap having a fully open position where the flap is inside the carton resting against the carton wall to which it is connected, and three of the closure flaps each having a closed position where they are positioned at an angle slightly inside the carton for retaining cigarette packs inside the carton, wherein the three closure flaps each has an outer edge portion for engaging a lowermost cigarette pack in the carton for retaining cigarette packs inside the carton when those three closure flaps are in their closed positions while allowing removal and insertion of cigarette packs when all four of the closure flaps are in their fully open positions, and wherein the fourth closure flap is constructed and arranged to remain in its fully open position without securement to the carton wall to which it is connected when the remaining three flaps are positioned at an angle slightly inside the carton for retaining cigarette packs inside the carton.

2. A cigarette carton as in claim 1 in combination with a plurality of similarly shaped cigarette packs inside the carton.

* * * * *